US007341812B2

(12) United States Patent
Wu et al.

(10) Patent No.: US 7,341,812 B2
(45) Date of Patent: Mar. 11, 2008

(54) PHOTOSENSITIVE MEMBER HAVING TWO LAYER UNDERCOAT

(75) Inventors: Jin Wu, Webster, NY (US); Yuhua Tong, Webster, NY (US); Geoffrey M T. Foley, Fairport, NY (US); Liang-Bih Lin, Rochester, NY (US); Jennifer Y. Hwang, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 322 days.

(21) Appl. No.: 11/107,133

(22) Filed: Apr. 14, 2005

(65) Prior Publication Data

US 2006/0234147 A1 Oct. 19, 2006

(51) Int. Cl.
*G03G 15/04* (2006.01)
*G03G 15/00* (2006.01)

(52) U.S. Cl. ..... 430/63; 430/60; 430/62; 399/159

(58) Field of Classification Search ..... 430/60, 430/62, 63; 399/159
See application file for complete search history.

(56) References Cited

U.S. PATENT DOCUMENTS 5,079,117 A * 1/1992 Koyama et al. ..... 430/59.6
5,110,700 A * 5/1992 Teuscher et al. ..... 430/64
5,628,932 A * 5/1997 Linton ..... 252/521.5
5,688,621 A * 11/1997 Takegawa et al. ..... 430/64
5,876,636 A 3/1999 Schlueter, Jr. et al.
5,922,440 A 7/1999 Schlueter, Jr. et al.
5,985,419 A 11/1999 Schlueter, Jr. et al.
5,995,796 A 11/1999 Schlueter, Jr. et al.
6,201,945 B1 3/2001 Schlueter, Jr. et al.
6,210,947 B1 * 4/2001 Dobson ..... 435/252.1
2003/0215731 A1 * 11/2003 Saiki et al. ..... 430/110.3
2004/0161683 A1 * 8/2004 Wu et al. ..... 430/59.1

OTHER PUBLICATIONS

Diamond, Handbook of Imaging Materials, 3rd Ed., Marcel Dekekr, Inc., NY, NY. 1991.*

* cited by examiner

*Primary Examiner*—Mark F. Huff
*Assistant Examiner*—Peter Vajda
(74) *Attorney, Agent, or Firm*—Annette L. Bade

(57) ABSTRACT

An imaging member having a substrate, an electroconducting layer having an electroconducting particle of a core and outer shell, an interfacial layer, and a charge transport layer with charge transport materials dispersed therein.

21 Claims, 1 Drawing Sheet

PHOTOSENSITIVE MEMBER HAVING TWO LAYER UNDERCOAT

BACKGROUND

Herein are disclosed photosensitive members, photoreceptors, or photoconductors useful in electrostatographic apparatuses, including printers, copiers, other reproductive devices, and digital apparatuses. In specific embodiments, the photoreceptors comprise a two-layer undercoat, which, in embodiments, comprises an electroconducting layer having an interfacial layer thereon. In embodiments, an electroconducting particle is dispersed or contained in one or more layers of the photosensitive member, such as, for example, the electroconducting layer. In embodiments, the electroconducting particle comprises an inert core and a conductive shell. In embodiments, the inert core comprises a silica, mica or titania, and the conductive shell comprises a metal oxide or a doped metal oxide. In embodiments, the doped metal oxide is antimony-doped tin oxide.

Electrophotographic imaging members, including photoreceptors or photoconductors, typically include a photoconductive layer formed on an electrically conductive substrate or formed on layers between the substrate and photoconductive layer. The photoconductive layer is an insulator in the dark, so that electric charges are retained on its surface. Upon exposure to light, the charge is dissipated, and an image can be formed thereon, developed using a developer material, transferred to a copy substrate, and fused thereto to form a copy or print.

Thick undercoat layer is desirable for photoreceptor life extension. In addition, thick undercoat layer does not demand high-quality substrate, thus enabling cheap substrates for low cost. Furthermore, a thick undercoat layer can prevent foreign material such as carbon fiber penetration into a photoreceptor, thus eliminating problem referred to as color spot. A one-layer thick undercoat is most desirable from a manufacturing standpoint. However, development of a one-layer thick undercoat is more difficult since there is a conflicting requirement associated with one-layer thick undercoats. Lower undercoat layer (UCL) resistivity is desired for efficient electron transport, and therefore, a lower residual potential for high thickness is desired. However, a lower UCL resistivity usually causes $V_{high}$ cycle down and charge deficient spots (CDS), which limit photoreceptor cycle time. Therefore, a two-layer undercoat concept is desired, since it separates hole-blocking function caused by a thin interfacial layer, and prevents foreign material penetration brought by a thick electroconducting layer. However, a two-layer design may be unfavorable from a manufacturing standpoint.

Therefore, there exists a need in the art for an improved photosensitive member. Desired is a photoreceptor having humidity-independent performance, excellent durability, and the ability to achieve a wide range of surface electrical resistivity (SER). In addition, it is desired to provide an undercoat layer system that is relatively easy to make. Moreover, it is desired to provide an undercoat system with plywood suppression. Further, improved dispersion quality is desired.

The photoreceptor herein comprises a two-layer undercoat layer configuration. The two-layer undercoat comprises an electron transporting layer (ECL) having electroconducting particles dispersed or contained therein, and an interfacial layer (IFL) thereover. The ECL can suppress plywood. Excellent dispersion quality can be achieved, in embodiments. The IFL can serve as a hole-blocking layer, in embodiments. In embodiments, a two-layer undercoat structure has demonstrated extended photoreceptor life, and has eliminated large black spot detection primarily due to penetration of foreign materials such as carbon fibers, into the photoreceptor. In addition, the undercoat (ECL) can suppress plywood. Further, excellent dispersion quality can be achieved, in embodiments. The preparation of the undercoat is relatively simple and is prepared by mixing without any milling process. Moreover, the photoreceptor has humidity-independent performance, excellent durability, and the ability to achieve a wide range of surface electrical resistivity.

SUMMARY

Embodiments include an imaging member comprising a substrate; an electroconducting layer comprising an electroconducting particle, said electroconducting particle comprising a core and an outer shell thereon; an interfacial layer; and a charge transport layer comprising charge transport materials dispersed therein.

Embodiments further include an imaging member comprising a substrate; an electroconducting layer having a thickness of from about 3 to about 40 microns, and comprising an electroconducting particle, said electroconducting particle comprising a hollow silica core and an outer shell comprising antimony doped tin oxide thereon; an interfacial layer having thickness of from about 0.001 to about 2 microns; and a charge transport layer comprising charge transport materials dispersed therein.

In addition, embodiments include an image forming apparatus for forming images on a recording medium comprising a) a photoreceptor member having a charge retentive surface to receive an electrostatic latent image thereon, wherein said photoreceptor member comprises a substrate, an electron transport layer comprising an electroconducting particle comprising a core and an outer shell thereon, an interfacial layer, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

BRIEF DESCRIPTION OF THE DRAWINGS

For a better understanding, reference may be had to the accompanying figures.

DETAILED DESCRIPTION

Figure 1:
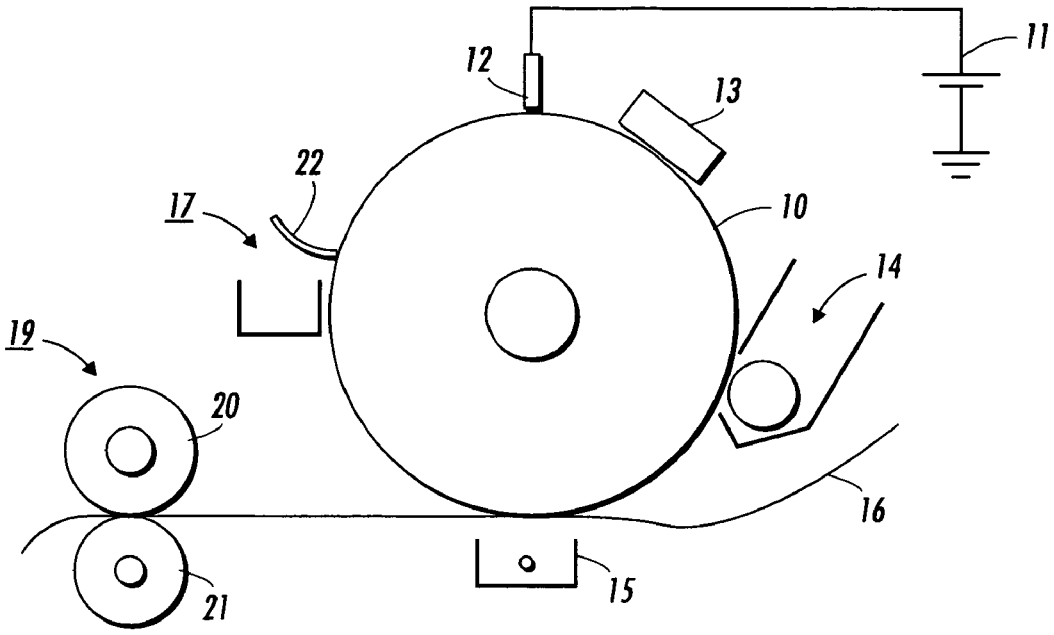
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
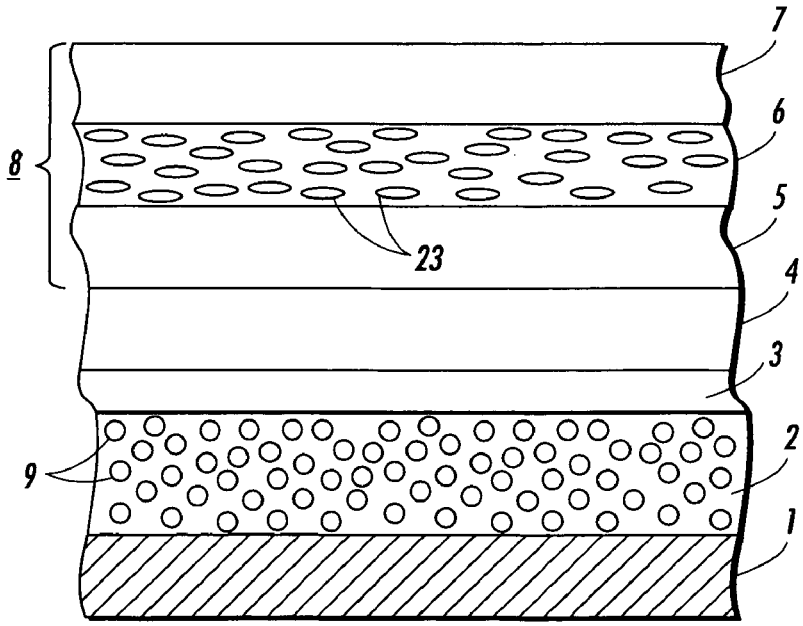
FIG. 2 is an illustration of an embodiment of a photoreceptor showing various layers and embodiments of filler dispersion.

Electrophotographic imaging members are well known in the art. Electrophotographic imaging members may be prepared by any suitable technique. Referring to FIG. 2, typically, a flexible or rigid substrate 1 is provided with an electrically conductive surface or coating 2.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. In embodiments, coating 2 is an electron transport layer discussed in detail below.

An optional hole-blocking layer 3 may be applied to the substrate 1 or coatings. Any suitable and conventional blocking layer capable of forming an electronic barrier to holes between the adjacent photoconductive layer 8 (or electrophotographic imaging layer 8) and the underlying conductive surface 2 of substrate 1 may be used. In embodiments, layer 3 is an interfacial layer discussed in detail below.

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air-drying and the like.

At least one electrophotographic-imaging layer 8 is formed on the adhesive layer 4, blocking layer or interfacial layer 3 or substrate 1. The electrophotographic imaging layer 8 may be a single layer (7 in FIG. 2) that performs both charge-generating and charge transport functions as is well known in the art, or it may comprise multiple layers such as a charge generator layer 5 and charge transport layer 6 and overcoat 7.

The charge-generating layer 5 can be applied to the electrically conductive surface, or on other surfaces in between the substrate 1 and charge-generating layer 5. A charge-blocking layer or hole-blocking layer 3 may optionally be applied to the electrically conductive surface prior to the application of a charge-generating layer 5. If desired, an adhesive layer 4 may be used between the charge blocking or hole-blocking layer or interfacial layer 3 and the charge-generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent-coated layer may be effected by any suitable conventional technique such as oven drying, infrared radiation drying, air-drying and the like.

The charge transport layer 6 may comprise a charge transporting small molecule 23 dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer 7 may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidenediphenylene)carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge-transporting polymer may also be used in the charge-transporting layer of this invention. The charge-transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

Any suitable and conventional technique may be used to mix and thereafter apply the charge transport layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air-drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Crosslinking agents can be used in combination with the overcoat to promote crosslinking of the polymer, thereby providing a strong bond. Examples of suitable crosslinking agents include oxalic acid, p-toluene sulfonic acid, phosphoric acid, sulfuric acid, and the like, and mixtures thereof. The crosslinking agent can be used in an amount of from about 1 to about 20 percent, or from about 5 to about 10 percent, or about 8 to about 9 percent by weight of total polymer content.

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range up to about 10 micrometers. In embodiments, the thickness is from about 1 micrometer and about 5 micrometers. Any suitable and conventional technique may be used to mix and thereafter apply the overcoat layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air-drying, and the like. The dried overcoating of this invention should transport holes during imaging and should not have too high a free carrier concentration. Free carrier concentration in the overcoat increases the dark decay. In embodiments, the dark decay of the overcoated layer should be about the same as that of the unovercoated device.

A two-layer undercoat system may be used in the photoreceptor. In embodiments, a relatively thick electroconducting layer (ECL) shown as 2 in FIG. 2, having an electroconducting particle 9 contained therein, is covered with a relatively thin interfacial layer shown as 3 in FIG. 2.

In embodiments, the electroconducting particle 9 is a micron-size particle and consists of an inert core and a conductive shell, in which the inert core can be silica, mica, titania, or the like. The conductive shell can be an n-type semiconductor, for example, a metal oxide or a doped metal oxide. In embodiments, the metal oxide or doped metal oxide may be selected from the group consisting of titanium oxide, zinc oxide, tin oxide, aluminum-doped zinc oxide, antimony doped titanium dioxide, antimony doped tin oxide, similar doped oxides, and mixtures thereof. An example of a suitable electroconducting particle is ZELEC® ECP available from Milliken Chemical. ZELEC® ECP consists of a dense layer of crystallites of antimony-doped tin oxide on an inert core particle. The antimony-doped tin oxide is the conductive phase. The antimony is in solid solution with the tin oxide. The inert core serves as an extender particle such as silica, mica, titania, or the like. The particles are of light colors and provide many other benefits including humidity-independent performance, excellent durability, and the ability to achieve a wide range of surface electrical resistivity (SER). In embodiments, ZELEC® ECP-S types can be used. These have a unique hollow silica core. The low density and elliptical shape provide excellent dispersibility in polymeric solutions. Examples of ZELEC® ECP-S include 1610-S (3 μm, oil absorption about 210 g/100 g), 2610-S (3 μm, oil absorption about 150 g/100 g), 1703-S (3 μm, oil absorption about 230 g/100 g) and 2703-S (3 μm, oil absorption about 170 g/100 g).

In embodiments, the electroconducting particle has a particle diameter of from about 1 to about 10, or from about 3 to about 5 microns.

In embodiments, the electroconducting particle is present in the ECL in an amount of from about 1 to about 15, or from about 2 to about 10 by weight of total solids. Total solids as used herein refer to the total amount of solid material in the layer, including the amount of polymer, filler, additives, and other solid materials.

In embodiments, the ECL comprises a polymeric binder of which the electroconducting particle is contained or dispersed therein. Examples of suitable polymeric binders include phenolic resins (such as thermally crosslinkable phenolic resins), melamine resins, epoxy resins, polyamide resins, acrylic resins, polyvinyl butyral resins, polyurethane resins, polyester resins, silicone resins, vinyl chloride resins, vinyl acetate resins, polyethylene, polypropylene, polystyrene, and copolymers thereof having more than two repeating units, casein, gelatin, polyvinyl alcohol, ethyl cellulose, and the like. A commercially available example of a phenolic resin is a thermally crosslinkable phenolic resin such as, for example, VARCUM®, available from Oxychem. A commercially available example of a suitable melamine resin is CYMEL from Cytec. A commercially available example of a suitable epoxy resin is EPON fro Shell Chemicals. A commercially available example of a suitable polyamide resin is copolymer NYLON resin or N-methoxymethyl NYLON resin from Toray Industries. A commercially available example of a suitable polyvinyl butyral resin is BUTVAR from Solutia. A commercially available example of a suitable vinyl chloride/vinyl acetate resin is UCAR from Dow Chemical. A commercially available example of a suitable cellulose resin is PHARMACOAT from Shin-Etsu Chemical.

In embodiments, the ECL is relatively thick and has a thickness of from about 3 to about 40 micrometers, or from about 5 to about 30 micrometers, or from about 10 to about 20 micrometers.

The interfacial layer (IFL) comprises a polymer. In embodiments, there may be a filler, such as, for example, a metal or metal oxide, dispersed therein, and may include, in embodiments, an amino silane. Examples of suitable fillers include metal oxides such as titanium oxide, zinc oxide, or the like. Specific examples include organotitanium or organozirconium compounds, such as titanium isopropoxide, zirconium isopropoxide, titanium methoxide, titanium butoxide, zirconium butoxide, titanium ethoxide, zirconium acetylacetonate tributoxide, and the like, and mixtures thereof. Other specific examples include nitrogen-containing organotitanium or organozirconium compounds, or a mixture of these materials, as disclosed for example, in U.S. Pat. Nos. 4,291,110, 4,338,387, 4,286,033 and 4,291,110, the disclosures of these patents being incorporated herein in their entirety. The metal or metal oxide is present in an amount of from about 1 to about 99 percent, or from about 30 to about 70 percent, or from about 40 to about 60 percent by weight of total solids.

The IFL comprises a polymer such as phenolic resin, polyamide resin, melamine resin, epoxy resin, polyvinyl butyral resin, polyurethane resin, and polyester. A specific example of a polyester resin is an aromatic polyester resin, such as those available as MOR-ESTER® 49,000 from Morton International. Other examples of suitable polymers include a copolyester resin such a for example, VITEL® PE-100, VITEL® PE-200, VITEL® PE-222, all available from Goodyear Tire and Rubber Co.; a polyarylate resin available as ARDEL® D-100 from Boedeker Plastics; a phenolic resin available as VARCUM® from OxyChem; an alcohol soluble nylon resin such as a copolymer nylon polymerized with NYLON-6, NYLON-6,6, NYLON-6,10, NYLON-11, NYLON-12 and the like; and nylon which is chemically denatured such as N-alkoxymethyl denatured nylon and N-alkoxyethyl denatured nylon.

In embodiments, the IFL may comprise a polymer with aminosilane and a metal or metal oxide contained therein. Examples of suitable aminosilanes include 3-aminopropyltrimethoxysilane (γ-APS), 3-aminopropyltriethoxysilane, 3-aminopropyldiisopropylethoxysilane, aminophenyltrimethoxisilane, 3-aminopropylmethyldiethoxysilane, 3-aminopropylpentamethyldisiloxane, and the like. In embodiments wherein there is included an amino silane, the amino silane is present in an amount of from about 5 to about 85 percent, or from about 15 to about 80 percent of the polymer.

The interfacial layer is relatively thin, and has a thickness of less than about 2 micrometers, or from about 0.001 to about 2 micrometers, or from about 0.01 to about 2 micrometers.

The micro-size particles in undercoats scatter the light, in embodiments, thus eliminating plywood-like print defects.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Electroconducting Layer having Doped Metal Oxide

An electroconducting layer was prepared by mixing 10 grams of ZELEC® ECP 2703-S (Example 1A), or ZELEC® ECP 1703-S (Example 1B), or ZELEC® ECP 2610-S (Example 1C) (about 3 micrometers particle diameter from Milliken Chemical) with about 80 grams of VARCUM® resin (a thermally crosslinkable phenolic resin, about 50 weight percent in xylene/1-butanol (50/50) from OxyChem) and about 20 grams of methyl ethyl ketone (MEK) for overnight. A good dispersion was obtained. The dispersion was coated on a 30×340 mm aluminum substrate, dried at 160° C. for about 15 minutes, and an average dry thickness of about 20 μm was obtained.

Example 2

Preparation of Electroconducting Layer having Doped Metal Oxide

An ECL dispersion was prepared by mixing overnight, an amount of 10 grams of ZELEC® ECP 1703-S (about 3 micrometers particle diameter, Milliken Chemical) with 233 grams of CM8000 resin (a copolymer nylon resin, Toray Industries), 9.6 grams of methyl alcohol, and 17.8 grams of 1,2-dicloroethane. The dispersion was coated, dried at 110° C. for about 20 minutes, and an average dry thickness of 15 μm was obtained.

Example 3

Preparation of Interfacial Layer

An interfacial layer (IFL) was then coated on the ECL. A wet coating was prepared by dissolving 0.5 percent by weight based on the total weight of the coating solution of a polyester (MOR-ESTER 49,000, available from Morton International, Inc.) in a 70/30 volume mixture of tetrahydrofuran/cyclohexanone. The wet coating was allowed to dry for 5 minutes at 135° C. The resulting IFL had a dry thickness of about 0.05 μm.

Example 4

Preparation of Interfacial Layer

An IFL solution was prepared by mixing 1 gram of γ-aminopropyltriethoxy silane (available from Dow Chemical), 4 grams of distilled water, 0.3 gram of acetic acid, 74.7 grams of 200 proof denatured alcohol and 20 grams of heptane. This layer was then allowed to dry for 5 minutes at 135° C. The resulting IFL layer had an average thickness of 0.06 μm.

Example 5

Preparation of Interfacial Layer

An IFL solution was prepared by mixing 4 grams of titanium isopropoxide (98+ percent, Fisher Scientific) directly into a brown bottle containing 4 grams of 3-aminopropyltrimethoxysilane (97 percent, Fisher Scientific) with slight stirring. The exothermic reaction occurred instantly to give a clear solution. The reaction was stoichiometric, generating an ammonium titanate complex. This solution was allowed to cool naturally until it reached room ambient temperature about 24° C.). The cooled solution was added into a polymer solution containing 1.5 grams of polyvinyl butyral BM-1 (Sekisui Specialty Chemicals Company) in 20 grams of 1-propanol. This layer was then allowed to dry for 30 minutes at 160° C. The resulting IFL layer had an average thickness of 1 μm.

Example 6

Preparation of Interfacial Layer

An IFL was fabricated from a coating dispersion consisting of titanium dioxide ($TiO_2$ STR-60N, Sakai) and phenolic resin (Varcum 29159, OxyChem) in xylene/1-butanol (wt/wt=50/50). The weight ratio of titanium dioxide and phenolic resin was 60/40. This dispersion was milled in an attritor with 0.4-0.6 mm $ZrO_2$ beads for 6 hours. The IFL was dried at 145° C. for 45 minutes. The resulting layer had a thickness of about 1 micrometer.

Example 7

Preparation and Testing of Photoreceptor Devices

After the ECL and IFL were coated, a charge generating layer was coated on top of them. The charge generating coating dispersion was prepared by dispersing 15 grams of hydroxygallium phthalocyanine (V) particles in a solution of 10 grams of UCARMAG-527 (available from Union Carbide Co.) in 368 grams of n-butyl acetate. This dispersion was milled in an attritor with 1 mm glass beads for 3 hours. The photoreceptor device with the ECL/IFL then was ring-coated with the charge generating coating dispersion. The resulting coated drum is air dried to form an approximate 0.2 to about 0.5-micrometer thick charge generating layer.

A charge transport layer was coated subsequently using a solution of a mixture of 60 weight % of PCZ400 (a polycarbonate, available from Mitsubishi Gas Chemical Company, Inc.), and 40 weight % of charge transport molecule N,N'-diphenyl-N,N'-bis(3-methylphenyl)-[1,1'-biphenyl]-4,4'-diamine. The solution was in 70:30 by weight ratio of tetrahydrofuran:toluene solvent mixture, providing an approximate solids content of about 23 to about 33% by weight. The charge transport layer was dried at 120° C. for 40 minutes. The dried charge transporting layer thickness was about 26 microns.

The above devices were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristics curves. The photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters. The exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were obtained from the two different pre-exposed surface potentials, and the data was interpolated into PIDC curves at an initial surface potential of 600 volts. The following table summarizes the $V_{low}$ of 9.0 ergs/cm$^2$ exposure energy for these devices. $V_{low}$ is the surface potential of the device subsequent to a certain light exposure at a certain time delay after the exposure.

TABLE 1

| ECL | Example 1A | Example 1B | Example 1C | Example 1D | Example 1A |
|---|---|---|---|---|---|
| IFL | Example 5 | Example 5 | Example 5 | Example 5 | Example 6 |
| $V_{low}$ (V) | 75 | 83 | 89 | 110 | 84 |

All the devices show reasonably $V_{low}$. When IFL is Example 5, the device with ECL (Example 1A) shows lowest $V_{low}$, which indicates that ZELEC ECP-2703S is most conductive among the four ZELEC ECP fillers cited in the invention. When ECL is Example 1A, the device with IFL (Example 5) shows lower $V_{low}$ than the device with IFL (Example 6), which indicates that the former IFL is more conductive. All the devices show stable cycling properties in varying environments. Excellent print quality is observed for all the devices.

While the invention has been described in detail with reference to specific embodiments, it will be appreciated that various modifications and variations will be apparent to the artisan. All such modifications and embodiments as may readily occur to one skilled in the art are intended to be within the scope of the appended claims.

What is claimed is:

1. An imaging member comprising:

a substrate;

a two-layer undercoat comprising a) an electroconducting layer comprising an electroconducting particle, said electroconducting particle comprising a hollow silica core and an outer shell thereon;

and positioned on said electroconducting layer b) an interfacial layer; and a charge transport layer comprising charge transport materials dispersed therein.

2. An imaging member in accordance with claim 1, wherein said outer shell of said electroconducting particle comprises a metal oxide.

3. An imaging member in accordance with claim 2, wherein said metal oxide is selected from the group consisting of titanium oxide, zinc oxide, tin oxide, and mixtures thereof.

4. An imaging member in accordance with claim 2, wherein said metal oxide is a doped metal oxide selected from the group consisting of aluminum doped zinc oxide, antimony doped titanium dioxide, antimony doped tin oxide, and mixtures thereof.

5. An imaging member in accordance with claim 4, wherein said doped metal oxide is antimony doped tin oxide.

6. An imaging member in accordance with claim 1, wherein said electroconducting particle is present in the electroconducting layer in an amount of from about 1 to about 15 percent by weight of total solids.

7. An imaging member in accordance with claim 1, wherein said electroconducting particle has a particle diameter of from about 1 to about 10 microns.

8. An imaging member in accordance with claim 1, wherein said electroconducting layer has a thickness of from about 3 to about 40 microns.

9. An imaging member in accordance with claim 1, wherein said electroconducting layer further comprises a polymer selected from the group consisting of a phenolic resin, a melamine resin, an epoxy resin, a polyamide resin, a polyvinyl butyral resin, a polyurethane resin, polymers thereof, and mixtures thereof.

10. An imaging member in accordance with claim 9, wherein said phenolic resin is a thermally crosslinkable phenolic resin.

11. An imaging member in accordance with claim 9, wherein said polyamide resin is an alcohol soluble nylon resin and nylon which is chemically denatured with N-alkoxy methyl or N-alkoxy ethyl groups.

12. An imaging member in accordance with claim 1, wherein said interfacial layer comprises a polymer and metal oxide dispersed in said polymer.

13. An imaging member in accordance with claim 12, wherein said polymer is selected from the group consisting of phenolic resin, polyamide resin, melamine resin, epoxy resin, polyvinyl butyral resin, and polyurethane resin.

14. An imaging member in accordance with claim 12, wherein said metal oxide is selected from the group consisting of titanium oxide and zinc oxide.

15. An imaging member in accordance to claim 12, wherein said metal oxide is selected from the group consisting of titanium isopropoxide, zirconium isopropoxide, titanium methoxide, titanium butoxide, zirconium butoxide, titanium ethoxide, zirconium acetylacetonate tributoxide, and mixtures thereof.

16. An imaging member in accordance with claim 1, wherein said interfacial layer comprises an aminosilane.

17. An imaging member in accordance with claim 16, wherein said aminosilane is selected from the group consisting of 3-aminopropyltrimethoxysilane, 3-aminopropyltriethoxysilane, 3-aminopropyldiisopropylethoxysilane, aminophenyltrimethoxisilane, 3-am inopropylmethyld ethoxysilane, and 3-aminopropylpentamethyldisiloxane.

18. An imaging member in accordance with claim 1, wherein said interfacial layer has a thickness of from about 0.001 to about 2 micrometers.

19. An imaging member comprising:

a substrate;

an electroconducting layer having a thickness of from about 10 to about 20 microns, and comprising an electroconducting particle, said electroconducting particle comprising a hollow silica core and an outer shell comprising antimony doped tin oxide thereon;

an interfacial layer having thickness of from about 0.001 to about 2 microns; and a charge transport layer comprising charge transport materials dispersed therein.

20. An image forming apparatus for forming images on a recording medium comprising:

a) a photoreceptor member having a charge retentive surface to receive an electrostatic latent image thereon, wherein said photoreceptor member comprises a substrate, an electroconducting layer comprising an electroconducting particle comprising a hollow silica core and an outer shell thereon, an interfacial layer, and a charge transport layer comprising charge transport materials dispersed therein;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

21. An imaging member comprising:

a substrate;

an electroconducting layer comprising a hollow silica core having a coating comprising antimony doped tin oxide coated on said core;

an interfacial layer; and a charge transport layer comprising charge transport materials disbursed within.

* * * * *